United States Patent [19]
Rewitzer
[11] 4,318,264
[45] Mar. 9, 1982

[54] PROCESS AND APPARATUS FOR THE PACKAGING OF FIBROUS MATERIAL IN BALES

[75] Inventor: Siegfried Rewitzer, Ihrlerstein, Fed. Rep. of Germany

[73] Assignee: Hoechst Aktiengesellschaft, Frankfurt am Main, Fed. Rep. of Germany

[21] Appl. No.: 133,936

[22] Filed: Mar. 25, 1980

[30] Foreign Application Priority Data

Mar. 27, 1979 [DE] Fed. Rep. of Germany ..... 2911958

[51] Int. Cl.³ ..... B65B 1/24; B30B 15/06

[52] U.S. Cl. ..... 53/436; 53/528; 100/3; 100/246; 100/248

[58] Field of Search ..... 53/436, 438, 528, 526, 53/529; 100/3, 137, 41, 248, 246, 229 R, 138–143, 207

[56] References Cited

U.S. PATENT DOCUMENTS

| | | | |
|---|---|---|---|
| 467,783 | 1/1892 | Sailor | 100/3 |
| 2,169,667 | 8/1939 | Streun | 100/207 |
| 3,541,752 | 6/1968 | Ness | 53/526 X |
| 3,962,846 | 6/1976 | Neitzel et al. | 53/528 |
| 4,224,780 | 9/1980 | Rewitzer | 53/528 X |

FOREIGN PATENT DOCUMENTS 2042004 8/1970 Fed. Rep. of Germany .

*Primary Examiner*—R. L. Spruill
*Assistant Examiner*—K. Y. Lin
*Attorney, Agent, or Firm*—Curtis, Morris & Safford

[57] ABSTRACT

The invention relates to a process for the packaging of fibrous material, such as staple fibers or tow ribbons, in bales of high density by multi-stage compression and wrapping with two-dimensional packaging material and reinforcing bands. It further relates to equipment suitable for this process. The material to be packaged is first placed in transportable press containers and pressed, transported in these containers to a central press, and then subjected to a main pressing step. The packaging and reinforcing of the bales produced are carried out in the central press which can be performed automatically if desired. By this invention it is possible to combine three or more laying-down and first-stage press devices, which may be supplied from different fiber lines, with a main press.

12 Claims, 11 Drawing Figures

PROCESS AND APPARATUS FOR THE PACKAGING OF FIBROUS MATERIAL IN BALES

Figure 1:
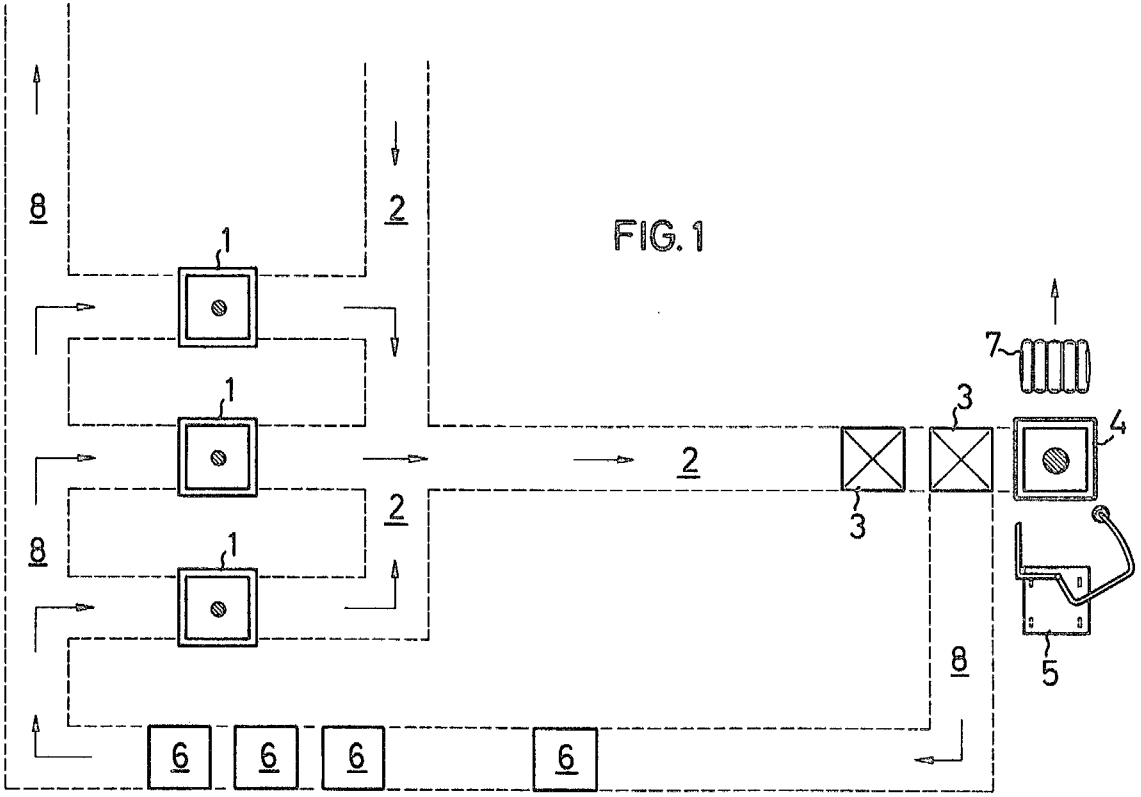
Figure 2:
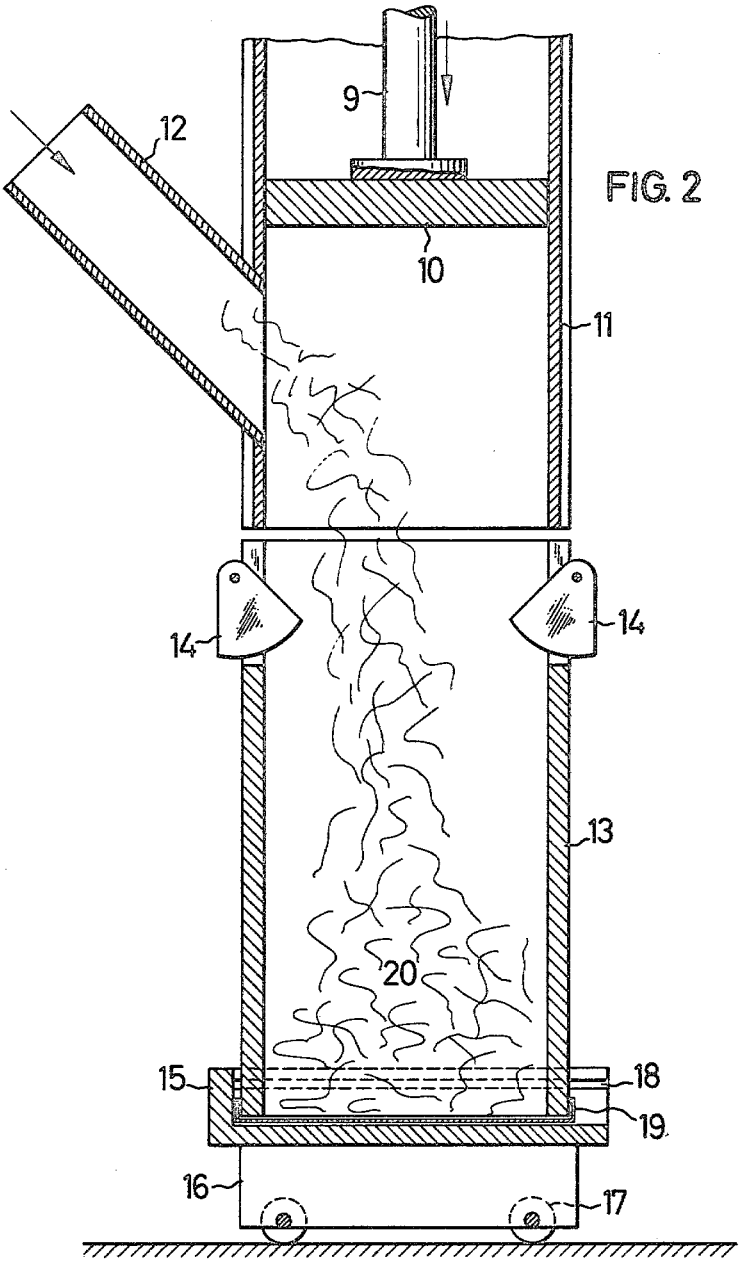

It has been known for a long time to collect fibrous material, such as staple fiber flocks, in turntable presses, to compress the material in several stages and to package it. Such a press is illustrated in FIGS. 1 and 2 of German Offenlegungsschrift No. 2,523,043. In presses of this type, the fibrous material is first collected in one half of a rotatable twin press box and initially pressed and after rotating the twin press box through 180° is subjected to the action of the main press ram. To reinforce the bales produced, banding grooves are used which are provided in the press ram, the bottom pressure plate and also in the side walls of the press ram. For inserting packaging material and for ejecting the finished bale, the side parts of the press box are designed as doors which can be opened while these working steps are carried out. Turntable presses of this type require a large number of operators since the insertion of the packaging material and in most cases also the insertion of the reinforcing bands must be performed manually. Furthermore, considerable down time is realized in the main press portion of the press since the operating cycle is predetermined by the speed of filling the first-stage press.

To ensure a better utilization of the main press system, it was recommended in German Auslegeschrift No. 2,042,004 to combine a main press with two first-stage press systems, it being intended to transport different press boxes on a predetermined circular path from a first-stage press part to the main press part. Although a twin turntable press of this type allows a better utilization of the main press part, the insertion of packaging material and reinforcing bands still remains difficult due to the given construction. In particular, automatic feeding of packaging material is at least made much more difficult because the first-stage presses are immediately adjacent.

In all the known turntable presses, the introduction of the two-dimensional packaging material involves considerable difficulties caused by the confined space due to the adjacent first-stage press parts. The problem can in general only be handled by the expenditure of a large amount of labor. For this reason, attempts have been made to prevent the insertion of two-dimensional packaging material before reinforcing and to effect this packaging only after the reinforcing step.

This manner of packaging, however, has not proven successful due to numerous disadvantages. For example, (1) the lower mechanical strength of the two-dimensional packaging means which are not fixed in their position by reinforcements and prevented from tearing further, (2) the risk of rust stains appearing in the packaged material due to corrosion of the reinforcing bands which are in direct contact with the material, and (3) the possibility of severing part tows during the packaging of tow ribbons as the fibrous material to be packaged.

Therefore, there is a need for a press system in which several, preferably three or more, first-stage presses cooperate in conjunction with a main or central press and in which the central press is so constructed that unhindered, if desired automatic, wrapping with packaging material and subsequent reinforcement, which likewise can be carried out automatically if desired, are possible.

It has now been found that such a compression of fibrous material and packaging with two-dimensional flexible packaging material and subsequent reinforcement of the bales can be achieved when the initial pressing of this material is carried out in several mutually independent first-stage presses which are equipped with transportable press containers having a releasable bottom plate. The fibrous material to be compressed is collected in the conventional manner in such a press container in a first-stage press and is initially pressed, the filled press containers are transported on a predetermined path, but without forced guiding, to a central press and, after the press container has been taken up without its bottom plate by the central press and the open end faces of the press container have been covered, the material is compressed in the central press in the transportable press container to a fraction of its initial volume by the action of the press ram of the central press. The surrounding press container is then completely removed from the material subjected to the force of the press and, preferably after wrapping the freely accessible side faces of the bale with a web of packaging material, the projecting surfaces of the packaging material are folded over by the action of, for example, two-dimensional or rod shaped holding-down devices and held on the surfaces of the bale. As a result of fixing the projecting surfaces of the packaging material, subsequent unhindered reinforcing of the bale with bands or the like can be achieved. After retraction of the holding-down devices and of the main press ram, the finished packaged bale can be removed from the central press while the empty press box is transported back to one of the first-stage presses after being recombined with its associated bottom plate.

In contrast to the known state of the art, the transportable press containers do not have any rigid connections to the central press, which force a motion of the press containers, for example on a circular path or the like. The press containers according to the invention have the shape of an open box of preferably rectangular cross-section, their lower opening being closed by a releasable bottom plate. Holding devices on the box-shaped part of the press container and the bottom plate ensure that the material to be pressed cannot come out of the lower opening of the box-shaped part of the press container during the initial pressing and transport. For the processing of fiber flocks, known retaining devices are provided in the vicinity of the upper opening of the box-shaped part, which retaining devices prevent the initially pressed material from swelling out between the individual initial pressing steps and during the transport to the central press. Suitable retaining devices and their operation have been described in German Auslegeschrift No. 1,938,602; however, other known systems of equivalent operation can also be used.

Since the transportable press containers according to the invention must withstand not only the pressure force of the first-stage press but also that of the central press, they preferably have reinforcing ribs or the like on their external surface, while the inner surfaces of the box-shaped part and of the bottom plate are preferably smooth and designed without recesses or grooves. Due to the absence of banding grooves and, in particular, due to the box shape without doors or the like, it is possible, however, to reduce the weight of a press container, including the retaining devices and the releasable bottom plate joined via holding devices, to such an extent that transport of such a container is possible, even in the filled state, without difficulties with the aid of conventional transport means, such as roller tracks or rail tracks, floor conveyors, overhead trolleys or the like.

Figure 3:
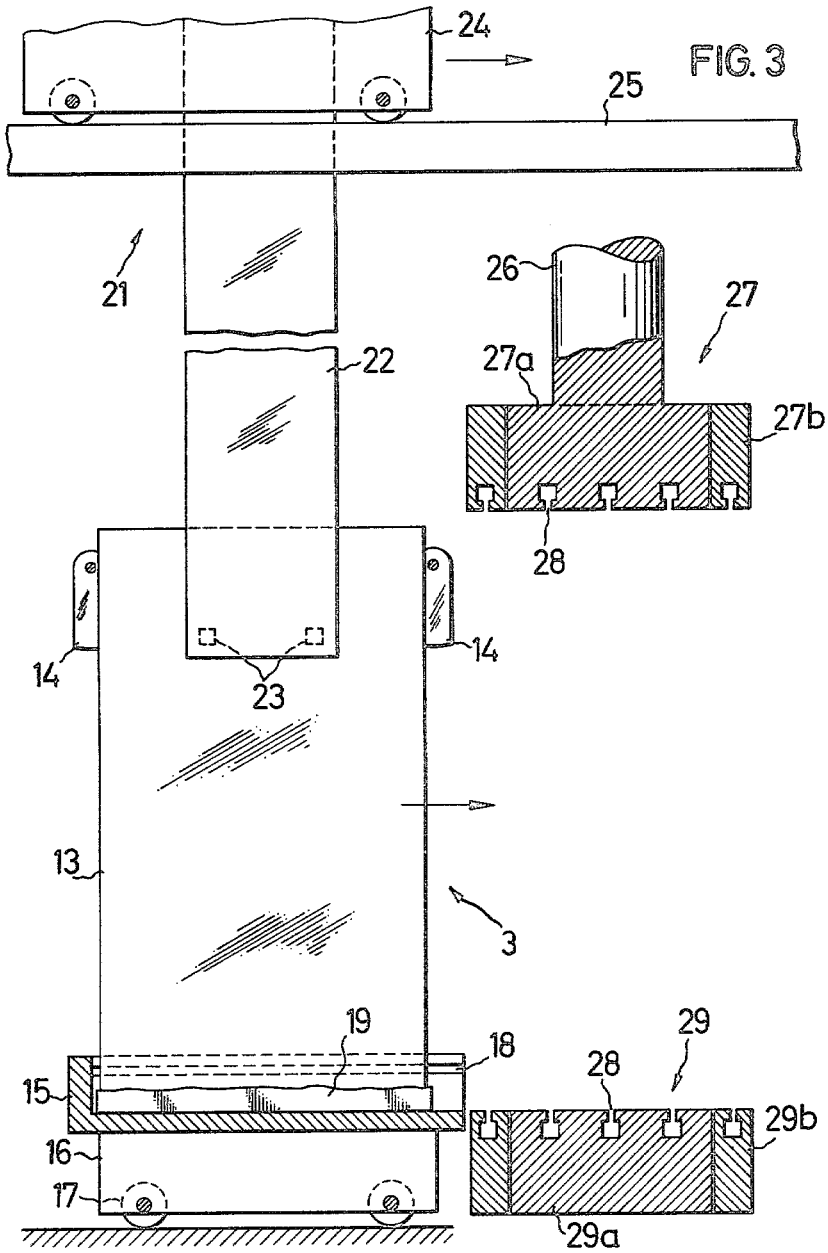

FIGS. 2 and 3 illustrate wheels, which are fixed to the bottom plates of the press boxes, as the transport devices for the press containers. For example, it is possible to move the press containers with the aid of these wheels on a rail system which can be designed with points, turntables, sidings and the like for the intermediate storage of the press containers.

The transport devices can, however, also consist, of a roller track system; in this case, the bottom plates of the press containers would need to have a smooth underside without projections. Roller tracks of this type have proven suitable for horizontal conveying of heavy piece goods; they can comprise driven rollers which facilitate the further transport of the containers.

Floor lift conveyors, such as, forklift trucks or lifting-and-conveying tractors, are also suitable for the transport of the press containers from the first-stage presses to the central press and back again. Conveying systems of this type are distinguished particularly by their spatial mobility since they are not tied to defined paths or track and points systems. When lifting conveyors of this type are employed, it can be an advantage to design the bottom plates of the press containers in the manner of transport pallets.

It is not absolutely necessary that the transport devices act on the bottom plate of the press containers. For example, an overhead trolley conveyor with corresponding tracks and points would also represent a suitable transport device. In this case, the press containers would have to be fitted on the outer surfaces of the box-shaped portion with suitable devices, such as, hooks or the like, which enable them to be connected to the overhead trolley system. The use of an overhead trolley system as the transport device can be an advantage since such transport devices are suitable for combination with the take-up and conveying devices which will be described below.

The various transport devices described above are to be understood as being illustrative only of a multiplicity of known transport devices. In one particular case, the arrangement of the various first-stage presses and of the central press, would be decisive for the transport devices which can be employed with particular advantage. Of course, combinations of different transport devices are also possible including transport on a roller track from which the press containers can be taken up by an overhead trolley or by floor conveyors.

The central press required for carrying out the process according to the invention must, corresponding to the press systems hitherto known, comprise a press ram which is of particularly strong design and which is preferably actuated hydraulically. If designed as a superstructure press, the required counter-pressure plate can be firmly anchored as a bottom pressure plate to the foundation. In contrast to known bale presses the central press according to the invention does not have press containers which are permanently joined thereto but instead, devices must be provided which enable the press containers transported to the central press to be taken up in the central press and to be fixed in the pressing position. Take-up devices of this type can, for example, consist of a gripper system which is capable of gripping a press container transported to the central press and to transport the box-shaped part of this press container without its bottom plate to a point above a surface in such a way that no initially pressed material can come out of the lower opening of the box-shaped part. Such a take-up system which runs on an overhead rail track is shown diagrammatically in FIGS. 3 and 4. This gripper system is capable not only of running the horizontal transport of the press container without its bottom plate to a point above a surface in such a way that no pressed material can come out, but is also capable of holding the box-shaped part of the press container in the exact pressing position of the central press during the pressing step.

Figure 4:
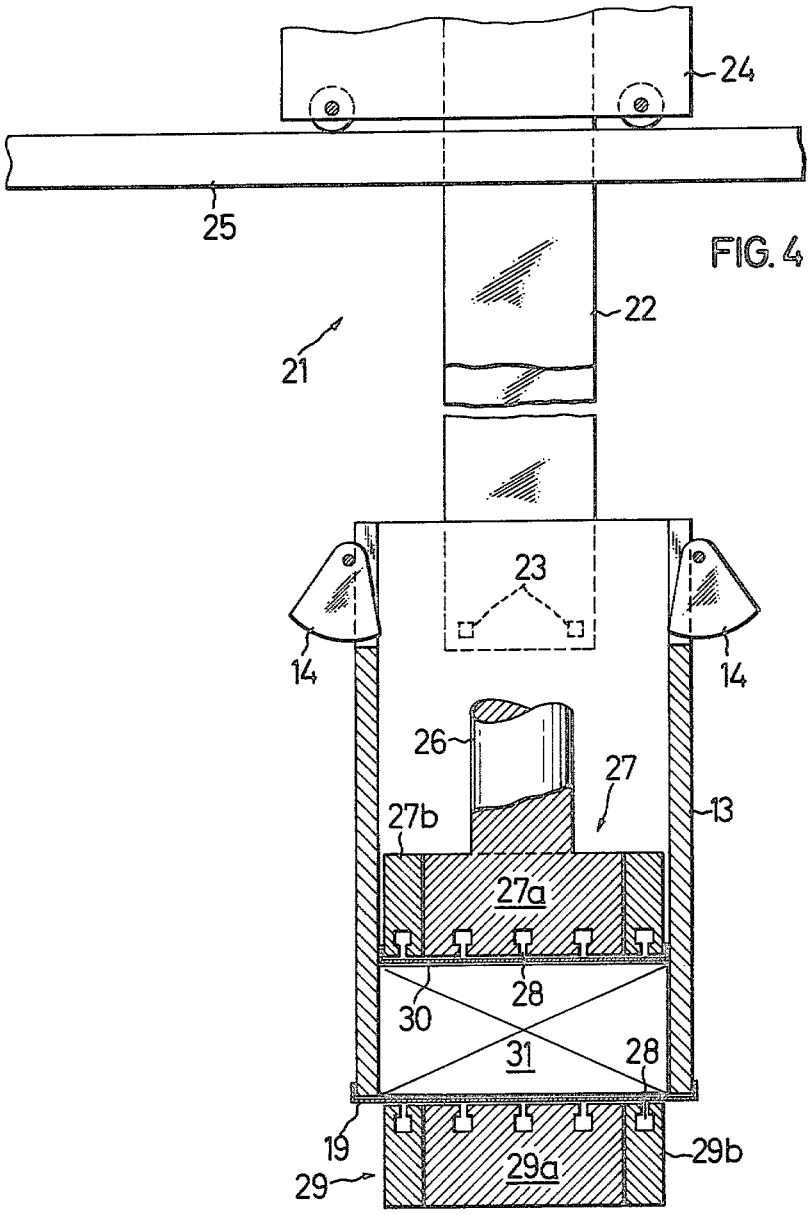
Figure 5:
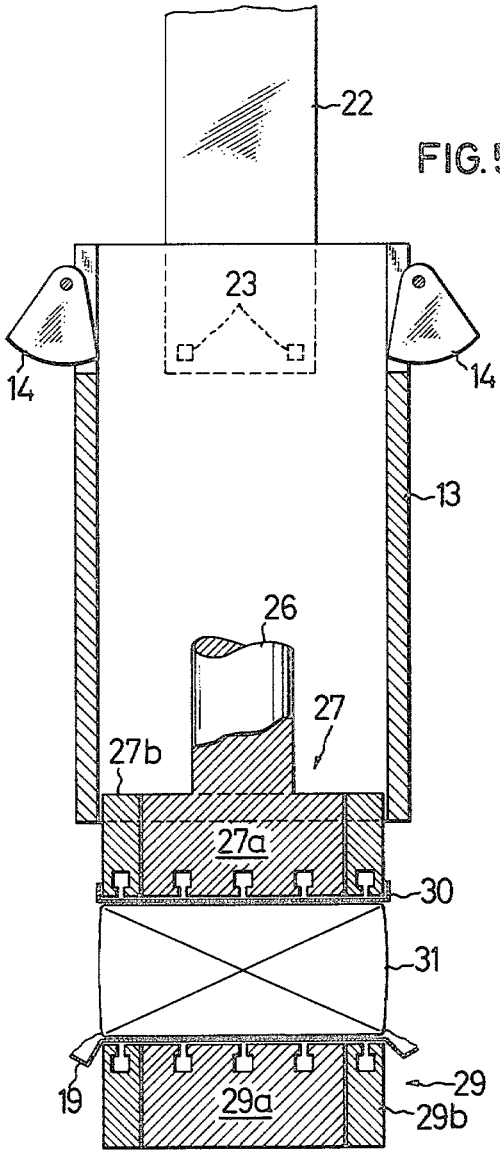

After the main pressing step has been carried out in the central press by lowering the press ram, conveying devices must intervene which enable the box-shaped part of the press container to be completely removed from the material pressed into a bale. These conveying devices can be provided as separate devices in the press and can, for example via gripper systems, pull the box-shaped part of the press container away upwards or downwards. In FIGS. 4 and 5, these conveying devices are part of the take-up device, that is to say the gripper device running on an overhead rail track also possesses pneumatic mechanisms which enable the box-shaped part of the press container to be pulled up from the pressed material.

The central press used is preferably a super-structure press, the press system of which rests on a yoke which is borne on columns. The distance of these columns from the press container in the pressing position or from the bale produced is here to be selected such that, after removal of the press container, all the side faces of the bale are accessible without hindrance. Only then is it possible to package the pressed bale in a simple manner, fully automatically if desired, and to reinforce it.

The process according to the invention and the press system required for this purpose enable the bales to be packaged in a particularly simple manner with two-dimensional flexible packaging material blanks, it being possible for the feeding and wrapping to take place fully automatically. As can be seen from the figures, only the press ram and the bottom pressure plate of the central press have bending grooves which are required for subsequent banding. Before carrying out the pressing step, this press ram and the bottom pressure plate must be covered by a blank of the desired packaging material. This covering, for example with a plastic film, is sufficient to prevent a penetration of the pressed material into the banding grooves. These packaging material blanks later cover at least the end faces of the pressed bale. These packaging material blanks can be introduced in such a way that the bottom pressure plate and the ram of the central press are each covered with one such blank before a press container is introduced into the central press with the aid of the take-up device. The position of the packaging material blanks can here be fixed by means of clamps, retainers or by the action of suction nozzles.

It is also possible, however, to place the packaging material blank for covering the lower end face at an earlier stage onto the bottom plate of a press container which is still empty and to fasten projecting ends of this blank to the box-shaped part of the press container, for example with the aid of clamps. In this case, covering of the bottom pressure plate of the central press with such a blank would be superfluous. It would then be necessary only to cover the upper end face of the press container or the pressing face of the press ram with a further blank before the main pressing step. In general, it is advantageous to select the surface area of the packaging material blanks for the end faces so as to be larger than the open cross-sectional area of the press container or of the eventual end faces of the bale produced. In principle, there are two possible ways of packaging bales of this type with the aid of packaging material blanks. One possibility is to select the packaging material blanks for the end faces to be of such a size that, after pressing, the protruding excess surfaces of these packaging material blanks are sufficient to cover all the side faces after folding, even with an overlap. Such a procedure, however, leads in general to difficulties on pressing since relatively large quantities of packaging material lay themselves around the press ram being lowered and, even after removal of the press box, difficulties can arise in folding the projecting packaging material blanks onto the side faces. Furthermore, there is a risk of damage to the protruding surfaces of the packaging material blanks during the pressing step. For this reason, packaging material blanks are preferably employed which project only a little beyond the end faces of the pressed bale. A protruding length of about 10 cm on each bale edge has proved to be particularly advantageous. In this embodiment of the process, the side faces of the bale are wrapped with a web-like further blank of packaging material, it being necessary to ensure that this web wrapping the side faces is held in its position until the banding of the bale has been completed. This can be effected in a simple manner, for example by welding, tacking, sewing, or the like, of the overlapping ends of this web under a certain pre-tension, and it is also possible to fix the ends of this web in their position by using rod-shaped or two-dimensional holding down devices which are, for example, hydraulically driven, until reinforcing has been completed.

Reinforcing with the aid of the banding grooves in the press ram and the bottom pressure plate can be carried out without trouble only if it is possible to reliably prevent the lateral openings of these banding grooves from being closed by projecting packaging material surfaces. For this reason, it is necessary to fold the protruding edge surfaces of the packaging material blanks over and to hold them on the surfaces of the bale until the risk of blocking the lateral openings of the banding grooves is no longer present. The folding-over and fixing of the protruding edge surfaces is advantageously carried out by the use of rod-shaped or two-dimensional holding-down devices which, for example, have a pneumatic drive and are fitted in the surfaces of the press ram and the bottom pressure plate. In another embodiment, these holding-down devices can also be mounted in frames which are brought close to the finished wrapped bale. The folding-over of the protruding edge surfaces can on the one hand be carried out in the direction of the side faces or, on the other hand, in the direction of the end faces of the bales. If folding onto the end faces is preferred, both the press ram and the bottom pressure plate must have an annular peripheral part which can be moved independently of the position of the main part. The two embodiments are represented in FIGS. 2 to 9, and the precise mode of functioning will be discussed in more detail below in conjunction with the individual figures.

Reinforcing of the bale already wrapped with packaging material can be effected in the conventional manner by means of tension wires, steel bands or the like. It is readily possible for this reinforcing also to be carried out by implements working automatically, these banding machines being fixed, for example, to the frames which already carry the holding-down devices.

After retraction of the holding-down devices and of the main press ram, the bale stands freely on the bottom pressure plate and can be removed from the press. Before pressing the contents of the next press container, the empty box-shaped press container must be removed from the press with the aid of the conveying devices and takeup devices, and advantageously it is immediately placed back onto the associated bottom plate. The empty box-shaped part lowered by the conveying devices can, for example, also be taken up by a further gripper device which puts this box-shaped part down at another suitable point, whilst the take-up device already transfers the next full press container into the central press. In this case, it is of course necessary to transport the associated bottom plate separately to a point where the second gripper device can recombine the box-shaped part with the bottom plate of the press container.

The figures represent illustrative embodiments of the process and of the press system. With the aid of the figures, it will be attempted to clarify the invention further, without thereby expressing a restriction or limitation of the invention.

FIG. 1 shows, in diagrammatic form, a spatial arrangement of the press system.

In FIG. 2, a first-stage press with a transportable press container is represented.

Figure 6:
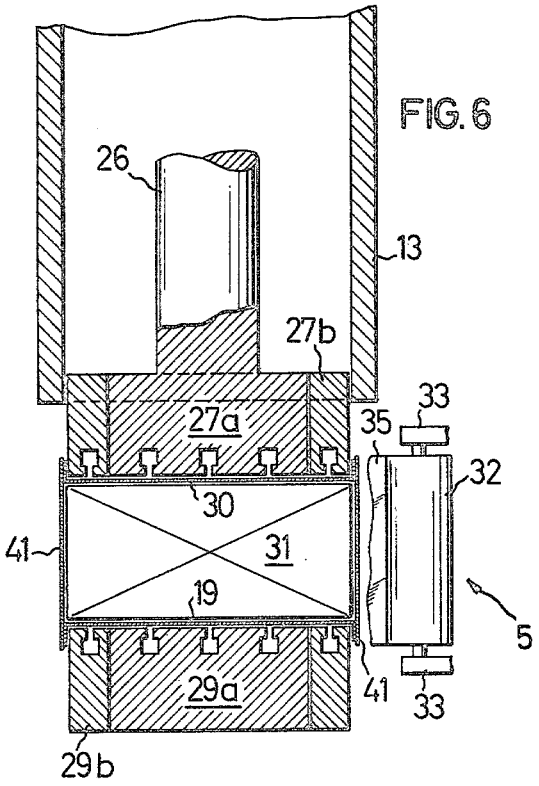
Figure 7:
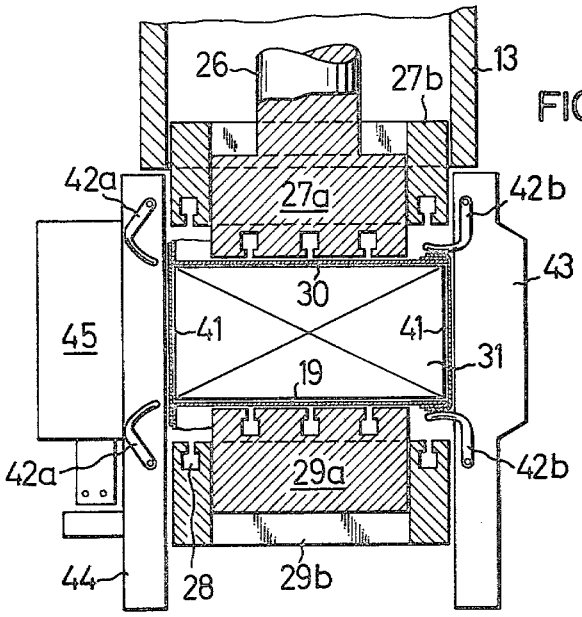
Figure 8:
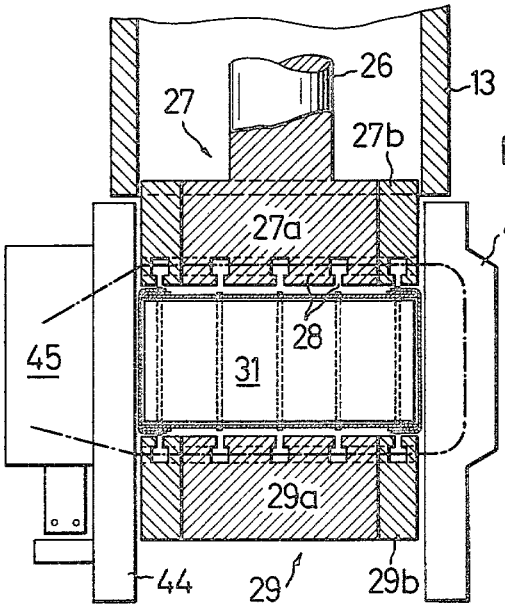

FIGS. 3 to 8 show various process courses in the central press, the following being particularly singled out: the take-up device in FIG. 3, the final pressed state in FIGS. 4 and 5, an automatic wrapping device for the side faces of the bale in FIGS. 6 to **6*b*, the folding-over of the protruding packaging material surfaces by means of holding-down devices in FIG. 7 and the procedure for reinforcing in FIG. 8**.

Figure 9:
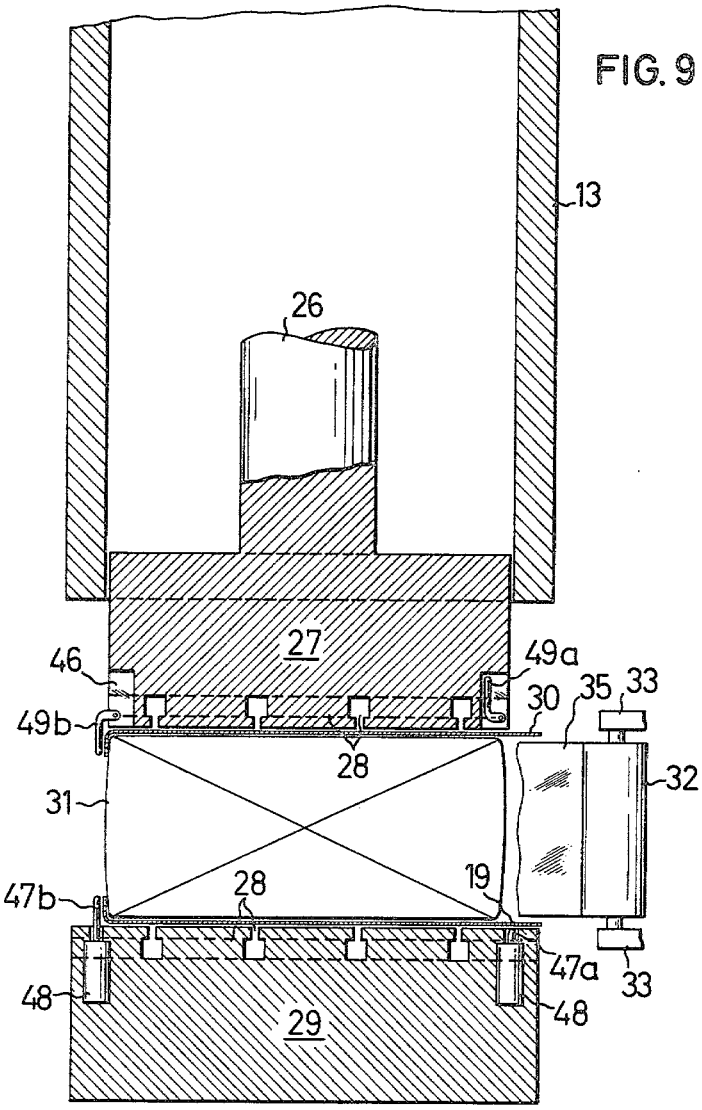

FIG. 9 shows another embodiment of the central press and of the required holding-down devices.

In FIG. 1, a possible spatial arrangement of the individual parts of the press system according to the invention has been represented. Three first-stage presses (1) are here connected via transport devices, such as, for example, roller tracks (2, 8) to the central press (4). The fibrous material to be compressed is collected in the first-stage presses (1) and initially pressed, and the filled press containers (3) are transported via a roller track (2) to the central press (4). The main pressing step takes place in this central press (4), and the pressed material is also provided with packaging material for the side faces by means of the wrapping device (5) working automatically and, after reinforcing, for example with steel bands, it can be transported away as a bale (7) ready for dispatch.

The empty press containers (6) are transported back to the first-stage presses (1) on a second roller track (8). The roller tracks (2 and 8) are each drawn with open ends in the vicinity of the first-stage presses (1) in order to indicate that, for example, further first-stage presses (1) can be taken into this system or that further empty press containers (6) or filled press containers (3) can stand in reserve on these open ends. Via these roller tracks (2 and 8), however, it is also possible to connect, for example, laying-down devices according to German Patent Specification No. 1,239,656 for the laying-down and initial pressing of filament tows, as long as these tow laying-down devices are so equipped that they make laying down and initial pressing in the empty press containers (6) possible.

In FIG. 2 a first-stage press part according to the invention is represented. The material to be compressed drops via a filling shaft (12) through the upper housing (11) of the first-stage press into a transportable press container which consists of a box-shaped part (13), retaining flaps (14) working automatically and a releasable bottom plate (15). The fibrous material is compressed under the action of the press ram (10) which can be moved by means of a piston rod (9), and gives the initially pressed material (20). The box-shaped part (13) of preferably rectangular or square cross-section is releasably joined to the bottom plate (15) via a holder device (18). This holder device can, for example, consist of a tongue and groove guide, the simplest form of which is to be found in the case of drawers. In the illustrative embodiment described here, a blank of packaging material (19) for the eventual lower end face of the bale was inserted before joining the box-shaped part (13) to the bottom plate (15). The transport devices used here are wheels (17) which are joined to the bottom plate (15) via a support structure (16) of the bottom plate.

Initial pressing is customarily carried out in the following way: the loose fibrous material is first collected in the interior of the box-shaped container (13) and the interior of the upper housing (11) and is compressed in the box-shaped part (13) of the press container by lowering the first-stage press ram (10). After the first-stage press ram (10) has been moved up again, the filling procedure is continued and the fibrous material is pre-compressed in the interior of the box-shaped part (13) by alternate filling and lowering of the first-stage press ram (10). The known retaining flaps (14) here have the purpose of preventing the pre-compressed material from swelling out of the box-shaped part (13). The position of the retaining flaps (14) can here be controlled, for example as a function of the position of the press ram (10). After the box-shaped part (13) has been filled with pre-compressed fibrous material, the press container, that is to say the box-shaped part (13), can be transported, together with the bottom plate (15), out of the region of the first-stage press with the aid of the wheels (17). Its place is then taken by an empty container, the bottom plate (15) of which is likewise covered again with a packaging material blank (19). The precise position of the press container relative to the press ram (10) can here be ensured by suitable locking devices which are not shown. The press container filled with a pre-compressed fiber material (20) can now be transported on a flat surface to the central press. This transport can be facilitated, for example, by a drive which is not shown or by traction devices.

In addition to the most essential parts of the central press, such as the press ram (27) and the bottom pressure plate (29) FIG. 3 shows a filled press container (3) with a bottom plate (15) and a combined take-up and conveying device (21). With the aid of the take-up and conveying device which can consist of a gripper device (22), an upper rolling truck (24) and a rail system (25), the box-shaped part (13) of the press container is moved horizontally into the working range of the press ram (27) of the central press, the holder devices (18) making it possible that the bottom plate (15) can be released from the box-shaped part (13) during this horizontal movement. Holder devices which are not shown ensure that the packaging material blank (19) does not change its position during this movement. The connection between the gripper devices (22) and the box-shaped part of the press container (13) can here be made, for example via suitable holder devices (23). In the present case, the central press ram (27) is divided into a core press ram (27*a*) and a peripheral press ram (27*b*) which surrounds the core ram (27*a*) like an annulus. Positioning of the press ram (27) is accomplished via the piston rod (26) by a drive which is not shown. Like the associated press ram, th bottom pressure plate (29) is dividied into a core pressure plate (29*a*) and a peripheral pressure plate (29*b*) which surrounds the core pressure plate like an annulus. Exact positioning of the box-shaped part (13) of the press container relative to the press ram (27) and the bottom pressure plate (29) can be effected by suitable locking means which are not shown and which, for example act on the take-up and conveying device (21). In the figure, banding grooves (28) which enable the bale to be reinforced later in the compressed state are also provided both in the press ram (27) and in the bottom pressure plate (29).

FIG. 4 shows the actual pressing of the fibrous material with the aid of the press ram (27*a* and *b*). The box-shaped part (13) of the press container is here held by the gripper device (22) of the take-up and conveying device (21). To carry out the process, it is essential that, before lowering the press ram (27*a*, 27*b*), the upper end face of the press box or the pressing surface of the press ram (27*a*, 27*b*) has been covered with a packaging material blank (30) for the upper end face of the bale (31). The insertion of the packaging material blanks (19) and (30) for the end faces of the eventual bale is necessary for several reasons. On the one hand, these blanks serve to prevent the banding grooves (28) of the press ram (27) and of the bottom pressure plate (29) from being blocked by material to be packaged and hence causing a hindrance in the later reinforcing or, possibly, contamination of the packaged material. In the process according to the invention, it is therefore not necessary that the fiber material collected and initially pressed is the same in all the first-stage presses (1). Rather, the process according to the invention makes it possible to package fibrous material of different types, that is to say also fiber flocks dyed in different colors. Without the insertion of the packaging material blanks (19) and (30), there is a risk of fiber material from a preceding pressing step remaining in the banding grooves (28) and still being present therein during a later pressing step of fibrous material of a different type. In addition, the packaging material of course also has the object of protecting the material pressed into a bale (31) against contamination during the later transport and storage.

In FIG. 5, the next process step is represented. Whilst the press ram (27*a*), (27*b*) remains unchanged in its position, the box-shaped part (13) of the press container has been completely removed, with the aid of the gripper device (22) of the take-up and conveying device (21) from the material (31) pressed into the shape of a bale. The drive means of the gripper device (22), required for this lifting movement, have not been shown here.

Figure 6B:
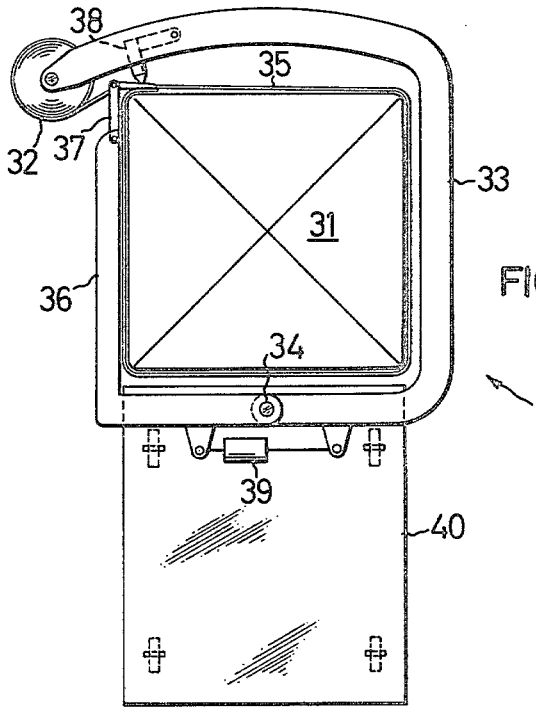
Figure 6A:
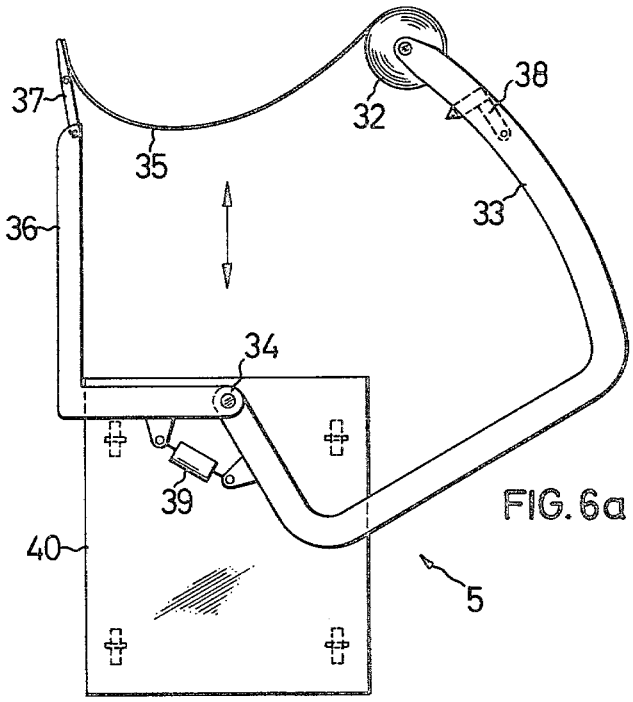

FIG. 6 shows automatic wrapping of the now exposed side faces of the bale (31) with packaging material, with the air of a wrapping device (5) working automatically. To clarify the construction and mode of action of this wrapping device (5) in more detail, the central press system is shown in FIG. 6 in cross-section, as in the preceding figures, whilst FIGS. 6*a* and 6*b* illustrate the course in time of the wrapping step in plan view. In FIG. 6, the pressed bale (31) is again shown which has packaging material blanks (19) and (30) on its end faces. Additionally, the side faces of the bale are now wrapped by a third blank of packaging material (41). This third packaging material blank (41) comes from a stock roll (32) which is held by arms (33).

The actual packing step can be seen in FIGS. 6*a* and 6*b* in time sequence. While, in FIG. 6*a*, one end of the packaging material web (35) is held by the swivel device (37) fixed to the carrier arm (36) and the stock roll (32) is swivelled out far with the aid of the swivel arms (33) and the pneumatic actuator (39), the entire device is moved with the aid of the transport car (40) towards the compressed bale (31) and thus reaches the end position which has been represented in FIG. 6*b*. As a result of the movement of the entire wrapping device (5) and of an additional swivel movement of the carrier arms (33) around the pivot point (34) and the swivelling-in of the swivel device (37) all the side faces of the bale (31) are enclosed by a film (35). While the film web (35) is held in this position, a severing and welding device (38) effects a joint between the overlapping packaging material webs. Due to the pre-tension, under which the wrapping was carried out, and due to the subsequent welding of the severed film web which, as the blank, carries the reference number (41), fixing of the position of this web is ensured at the same time. Subsequently, the stock roll (32) is swivelled back by a movement of the carrier arms (33) and retraction of the transport car (40). As soon as the wrapping device (5) working automatically has reached again the position according to FIG. 6*a*, it is necessary to ensure that the free end of the packaging material web (35) is taken up by the swivel device (37).

Reinforcing of the bale, now completely wrapped with packaging material, is not yet possible since the lateral openings of the banding grooves (28) are still at least partially covered by projecting packaging material surfaces. A possible way of folding these projecting packaging material edges over and holding them on the bale surface is shown in FIG. 7. Folding-over is here effected, analogously to the proposals of German Offenlegungsschrift No. 2,736,316, by lifting an annular peripheral part (27*b*) of the press ram, the core press ram (27*a*) remaining in the pressing position. At the same time, an annular peripheral pressure plate (29*b*) of the bottom pressure plate is lowered. The projecting packaging material surfaces can be folded into the resulting cavities on the end faces of the bale when appropriately shaped holding-down devices act thereon. In FIG. 7, these holding-down devices are held by special carrier frames (43), (44) which, after removing the box-shaped part of the press container (13), can be brought close to the pressed bale (31). In FIG. 7, the holding-down devices fixed to the carrier frame (44) are shown in the swivelled-in state (42*a*), whilst the holding-down devices (42*b*) of the carrier frame (43) are already in the swivelled-out working position. The swivelling movement of the holding-down devices about their pivot point can be effected by suitable drive mechanisms which, however, have not been represented in the figure.

The annular peripheral press ram (27*b*) and the annular peripheral pressure plate (29*b*) can be moved by suitable movement devices, such as, for example, hydraulic control pistons. They have suitable incisions which, during the return movement of the parts (27*b*) and (29*b*) into the initial pressing position, make damage to the swivelled-out holding-down devices (42*b*) impossible. After the peripheral press ram (27*b*) has been lowered again and the peripheral pressure plate (29*b*) has correspondingly been lifted, the holding-down devices (42*b*) can be moved in again since the press parts (27*b*) and (29*b*) now fix the packaging material surfaces in their folded position on the end faces of the bale.

The lateral openings of the banding grooves (28) are now freely accessible and can serve for reinforcing the finished compressed bale. Automatic banding of the bale with the aid of a banding device (45) which is likewise fixed to the carrier frame (44) has been indicated in FIG. 8. For automatic banding, it is necessary to provide appropriate devices for deflecting the reinforcing material from an upper banding groove in the press ran (27) to a lower banding groove in the bottom pressure plate (29). These deflection devices can be provided in the carrier frame (43). After retracting the carrier frames (43) and (44) and lifting the press ram (27*a*, 27*b*), the compressed bale remains in the finished packaged state on the bottom pressure plate (29*a*, 29*b*); it can be taken out of the press or it can be taken up via an ejector device which is not shown, for example, by further known transport means for products of this type.

To conclude the process, it is necessary that the box-shaped part (13) of the press container is lowered again with the aid of the take-up and conveying device (21) and is recombined with the associated bottom plate (15), the bottom plate (15) having been covered with a packaging material blank (19) before the combination. The empty press container can now be moved back again to a first-stage press by means of the transport device described and is ready there for another filling.

A variant of the process and of the required central press is represented in FIG. 9. In contrast to FIGS. 2 to 8, neither the press ram (27) nor the bottom pressure plate (29) is here divided into core and peripheral parts. The packaging material surfaces, protruding beyond the end faces of the bale, of the packaging material blanks (19) and (30) are here folded, with the aid of holding-down devices (47*a*, *b*), (49*a*, *b*), not onto the end faces but onto the side faces. The lever-like holding-down devices (49*a*, *b*) sunk into the recesses (46) of the press ram (27) can here execute their swivelling movement with the aid of conventional drive devices which are not shown. The holding-down device (49*a*) is drawn in the swivelled-in position, whilst the holding-down device (49*b*) is in the working position. Holding-down devices (47*a*, *b*) which can be moved with the aid of a pneumatic drive (48) are sunk into the bottom pressure plate (29). In contrast to the holding-down devices described so far, the holding-down devices (47*a*, *b*) only execute an up-and-down movement. The holding-down device (47*a*) is drawn in the moved-in position and the holding-down device (47*b*) is drawn in the moved-out position.

When employing a device according to FIG. 9, packaging and reinforcing of the bale (31) advantageously takes place as follows.

After lowering the press ram (27) and moving the holding-down devices out into their working position (47*b*), (49*b*), the side faces are wrapped with a web of packaging material (35). The width of this packaging material web was here selected such that it does not exceed the height of the side faces of the bale in the compressed state.

The packaging material web can here be applied to the side faces in the way already explained in FIGS. 6*a* and *b* and in the relevant text. In this process variant, wrapping of the side faces with packaging material takes place while the holding-down devices (47*b*), (49*b*) are already moved out. After fixing the packaging material web for the side faces by welding, tacking or the like, reinforcing of the bale is first carried out. Subsequently, the lower holding-down devices (47*b*) are moved in into the position (47*a*), whilst the press ram (27) with the holding-down devices still moved-out in the position (49*b*) is raised. The holding-down devices can be removed from their position between the individual packaging material blanks by this procedure and the bale stands free, ready to be transported away.

I claim:

1. In a process for the preparation of a bale of compressed fibrous material encased in a flexible packaging material by compressing said fibrous material in multiple stages and reinforcing said compressed bale of fibrous material with bands or other suitable reinforcing means, the improvement which comprises partially compressing fibrous material in a plurality of first-stage presses by charging the fibrous material to a transportable press container said press container having a releasable bottom plate and partially compressing said charged fibrous material therein, controllably transporting said charged press container along a pre-selected path to align with a central press unit having a reciprocating ram, encasing the open end faces of the partially compressed fibrous material with blanks of packaging material and then advancing said ram to compress the encased fibrous material into a bale of fibrous material, removing the press container from the bale of fibrous material while maintaining said ram in compressing position and encasing the open side faces of said bale with a web of packaging material, controllably folding and fastening any projecting surfaces of said blank or web of packaging material to said bale, reinforcing said bale with bands or other suitable reinforcing means, retracting said ram and then removing bale from said central press unit and transporting the empty transportable press container back to one of said first-stage presses.

2. The process of claim 1 wherein the width of said web of packaging material encasing said open side faces corresponds approximately to the height of the side of said bale of fibrous material.

3. The process of claim 2 wherein said projecting surfaces of said blank or web of packaging material is fastened to the bale until said bale has been reinforced.

4. The process of claim 1 wherein the width of said web of packaging material is greater than the height of the finished bale and said central press unit comprising a ram and a bottom pressure plate each having a periphery portion and a core portion, retracting said periphery portion of the ram and the bottom pressure plate and folding said blank or web of packaging material into the free space formed by the retraction of said periphery portion of the ram and the bottom pressure plate and fastening said material onto the side faces of the bale until said bale has been reinforced.

5. The process of claim 1 wherein said web of packaging material is welded, glued, tacked, sewed or clamped to the bale.

6. The process of claim 1 wherein said releasable bottom plate is encased with a blank of packaging material fastened to the outer surfaces of said press container before said press container is filled with fibrous material and the blank of packaging material for encasing the second end face of the bale is applied to said fibrous material before the fibrous material is compressed in said central press unit.

7. The process of claim 1 wherein the transportable press container is aligned with said central press unit by a take-up device adapted to releasably engage said transportable press container and after releasing holding means for the releasable bottom plate and side walls of said press container moving said press container into alignment with said central press unit without changing the position of said compressed fibrous material and/or lower packaging material blank.

8. A baling press system for multi-stage compression of fibrous material into bales and packaging said bales with two-dimensional flexible packaging material and reinforcing bands which comprises (a) a plurality of first-stage presses with transportable press containers having a releasable bottom plate and a box-shaped cross section said press containers adapted to receive a charge of fibrous material which can then be partially compressed therein, (b) transport means for controllably transporting said press containers along a pre-selected path from said first-stage presses to a central press unit and back to said first-stage presses, (c) a central press unit having a reciprocating ram for compressing the partially compressed fibrous material encased on the open end faces thereof by blanks of packaging material, further containing, means for aligning each press container with said central press unit without any change in position of said compressed fibrous material and/or packaging material, means for removing said press container from said fibrous material, and a multiplicity of rod-shaped or two-dimensional mechanical means for folding and fastening said packaging material to said bale.

9. The press system of claim 8 further comprising means for encasing the open side faces of said bale with a web of packaging material and fastening said web to the bale with reinforcing means for automatically reinforcing said compressed bales.

10. The press system of claim 8 wherein the transportable press containers are of an open box-shaped cross section with smooth inner surfaces, the lower end of said box-shaped container being sealed by and connected to a releasable bottom plate wherein means are provided for preventing any compressed fibrous material from swelling out of said container.

11. The press system of claim 8 wherein the transportable press container contains wheel or roller means for transporting said press container on a pre-selected path.

12. The press system of claim 8 wherein the ram of said central press unit is divided into a core ram and a surrounding peripheral ram in variable relative position to one another and the bottom pressure plate is analogously divided into a core pressure plate and a surrounding peripheral pressure plate in variable position to one another.

* * * * *